US005136942A

United States Patent [19]

Germann

[11] Patent Number: 5,136,942

[45] Date of Patent: Aug. 11, 1992

[54] WEB-FED PRINTING MACHINE FOR RECTO-VERSO PRINTING ESPECIALLY OF BANKNOTES

[75] Inventor: Albrecht J. Germann, Wurzburg, Fed. Rep. of Germany

[73] Assignee: De La Rue Giorgi S.A., Lausanne, Switzerland

[21] Appl. No.: 347,427

[22] Filed: May 4, 1989

[30] Foreign Application Priority Data

May 18, 1988 [CH] Switzerland ..... 1886/88

[51] Int. Cl.[5] ..... B41F 5/16; B41F 5/22; B41F 31/30

[52] U.S. Cl. ..... 101/177; 101/179; 101/182

[58] Field of Search ..... 101/177, 178, 179, 180, 101/181, 182, 220, 221, 137, 138, 143, 247, 351, 352, 142, 145

[56] References Cited

U.S. PATENT DOCUMENTS

| | | | |
|---|---|---|---|
| 3,041,966 | 7/1962 | Polglase, Jr. | 101/177 |
| 4,280,406 | 7/1981 | Corse | 101/177 |
| 4,633,777 | 1/1987 | Germann | 101/177 |

FOREIGN PATENT DOCUMENTS

| | | | |
|---|---|---|---|
| 1559998 | 1/1980 | United Kingdom | 101/220 |

*Primary Examiner*—J. Reed Fisher
*Attorney, Agent, or Firm*—Kane Dalsimer Sullivan Kurucz Levy Eisele and Richard

[57] ABSTRACT

The web-fed printing machine preferably intended for the printing of banknotes has two closely adjacent impression cylinders (2, 3), each of which interacts with several blanket cylinders (4, 6). Each blanket cylinder (4, 6) is inked by a plate cylinder (5, 7) which receives its ink from its own inking unit (9, 9'; 11, 11'). The paper web (P) runs between the respective impression cylinder (2, 3) and blanket cylinders (4, 6), partially looping first round one impression cylinder (2) and then in the opposite direction round the other impression cylinder (3), so that the two sides of the paper are successively printed directly with the individual colors. All the blanket and plate cylinders interacting with an impression cylinder (2, 3) are arranged on a respective common exchangeable machine stand (15, 16). Consequently, in order to exchange the blanket and plate cylinders for cylinders of a different diameter for the purpose of changing the printing format, the machine stands (15, 16) equipped with corresponding cylinders are exchanged as a whole.

8 Claims, 2 Drawing Sheets

WEB-FED PRINTING MACHINE FOR RECTO-VERSO PRINTING ESPECIALLY OF BANKNOTES

FIELD OF THE INVENTION

The invention relates to a web-fed printing machine for recto-verso printing, especially of banknotes.

PRIOR ART

In a known printing machine of this type, as described, for example, in EP-B-132,858 of the same applicant, the two cylinders are blanket cylinders which are pressed against one another and which are each inked with different colors by several offset plate cylinders; the paper passes through the nip between the two blanket cylinders and is thereby printed simultaneously on each of the two sides with a multi-color image collected on the respective blanket cylinder. This known recto-verso printing machine guarantees a perfect see-through register, that is to say a perfect register of the two printing images on the front and back of the paper, since of course both sides of the paper are printed simultaneously. However, the ink quantity transferred by the blanket cylinders or the thickness of the ink layers to be superposed on a blanket cylinder is limited, this being a restriction arising as a result of the mode of operation of this known printing machine.

When it is desirable to print a relatively large quantity of colors onto the paper and when the problems associated with superposing different colors on a blanket cylinder are to be avoided, it is necessary to ensure that the individual colors are printed directly onto the paper and are superposed only when they are there. On a printing machine working by this process, however, when a rectoverso print is to be produced there is the problem of the see-through register. In fact, when the individual colors are being applied directly to the paper, only one particular side of the paper can be printed, and with these known machines it is extremely difficult, if not impossible, to produce and maintain a perfect see-through register on one side of the paper and then the other during the printing operations taking place successively in terms of time and place. Even only very slight deviations from the correct paper position during the paper transport and minimal changes in the paper tension between the two printing operations result in register errors. But for a see-through register desirable in banknotes for reason of quality and safety against counterfeiting, even small register errors are unacceptable.

Furthermore, conventional web-fed printing machines working with the paper web running at a continuous feed speed make it possible to produce only a specific printing format which is determined by the diameter of the plate cylinders installed in the main stand.

SUMMARY OF THE INVENTION

The object on which the invention is based is to provide web-fed printing machine of the type indicated in the pre-characterizing clause of claim 1, by means of which a perfect see-through register is produced and maintained during printing and which can be converted in a simple way for the production of different printing formats, especially different banknote formats.

The web-fed printing machine according to the invention is preferably a multi-color offset-printing machine, that is to say an indirectly printing machine, in which the colors are transferred onto the paper from the plate cylinders via respective blanket cylinders, each of which is inked by a plate cylinder; these blanket cylinders are mounted together with the plate cylinders in two respective exchangeable machine stands. The offsetprinting machine can be a dry offset-printing machine working by the process of indirect typographic printing or a wet offset-printing machine or a printing machine working partly with typographic printing plates and partly with wet offset-printing plates. However, the web-fed printing machine according to the invention can also work by the process of direct typographic printing, in which case the plate cylinders ink the paper directly without intermediate blanket cylinders.

Since, according to the invention, the paper web is transferred directly from the first impression cylinder to the second closely adjacent impression cylinder and therefore need not run through any free space or even be guided by guide members between the two printing operations, a constant paper tension and consequently a perfect see-through register are advantageously guaranteed, since the possibility of register errors between the recto and the verso printing operations is virtually eliminated. Moreover, there is the technical advantage that, in order to change over the web-fed printing machine from one format to another, it is merely necessary to exchange the two machine stands, in which the plate cylinders and the blanket cylinders of the diameter corresponding to the first format are mounted, as a whole for another respective machine stand, the plate cylinders and blanket cylinders of which have the diameter corresponding to the other desired format. This exchange of entire machine stands constituting prepared exchangeable cylinder modules can be carried out substantially more simply and more quickly than if the numerous plate cylinders and blanket cylinders had to be exchanged individually in the main stand of the machine. In order to execute the in-register transfer of the paper web from the first impression cylinder to the second in an especially reliable way, preferably the distance between the two impression cylinders is adjustable as a function of the paper thickness and is of only an amount necessary for the passage of the paper between the two impression cylinders, so that the transfer of the paper from the first impression cylinder to the second impression cylinder takes place directly. At the same time, for example, the pressing force between the two impression cylinders can be at least approximately equal to that pressing force with which an impression cylinder and a blanket cylinder or plate cylinder are pressed against one another to form a nip.

Expedient further forms of the web-fed printing machine according to the invention emerge from the dependent patent claims.

BRIEF DESCRIPTION OF THE DRAWINGS

The invention is explained in detail with reference to the drawings by means of an exemplary embodiment of a wet offset-printing machine. In the drawings.

DESCRIPTION OF THE PREFERRED EMBODIMENTS

Figure 1:
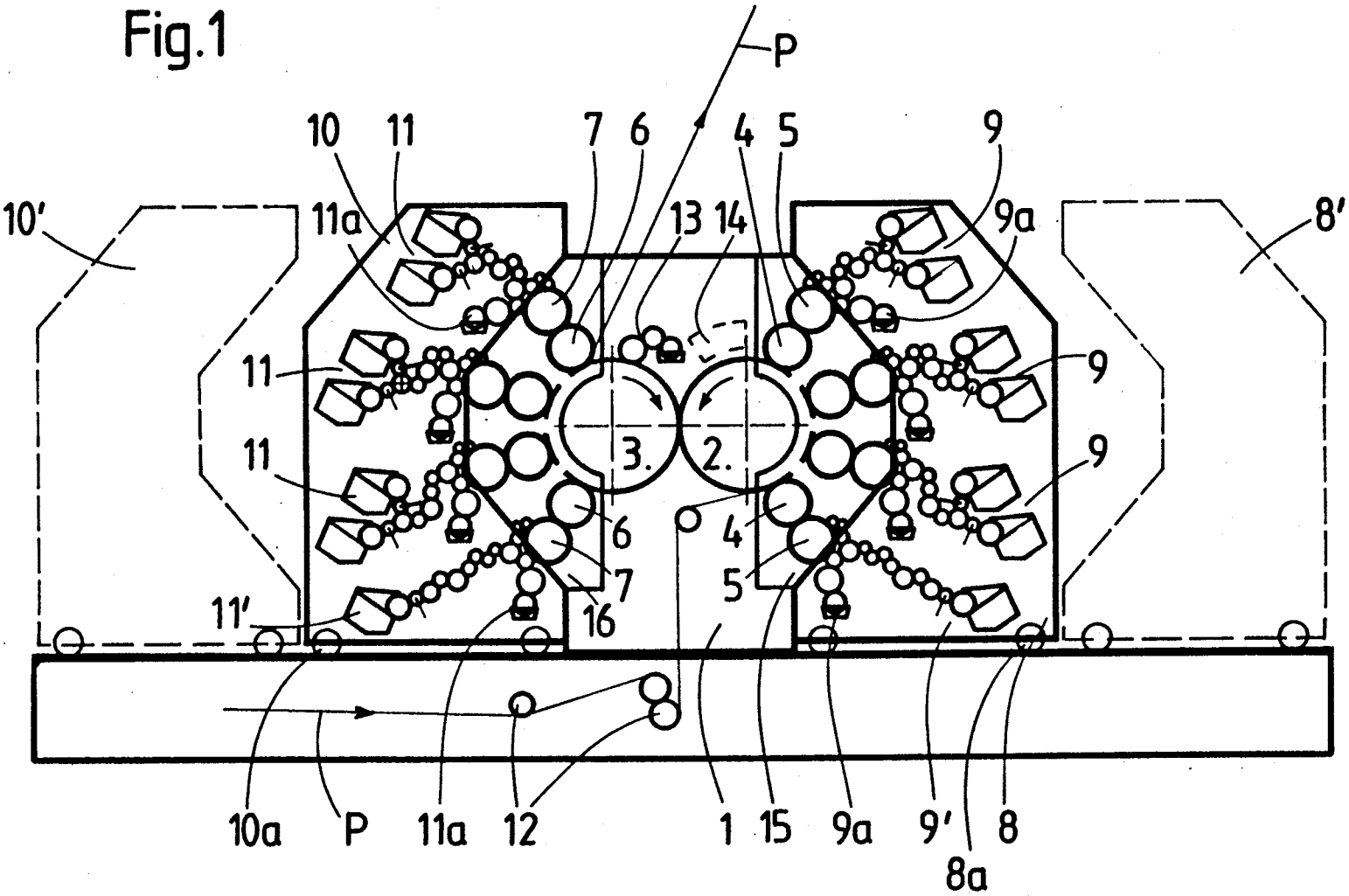
FIG. 1 shows a diagrammatic representation of this web-fed printing machine according to the invention.

Mounted next to one another in the main stand 1 of the machine are two impression cylinders 2 and 3 which are driven in the direction of the curved arrows and the gearwheels of which are intermeshed directly, free of play, to achieve a perfectly synchronous oppositely directed rotation. The two impression cylinders 2 and 3 have seamless continuous circumferential surfaces made of hard material, preferably metal. Arranged along the circumference of the impression cylinder 2 are four blanket cylinders 4, each of which is in contact with a plate cylinder 5 of the same diameter. Each of these plate cylinders 5 is inked with a different color by its own inking unit. The three inking units 9 with a double ink fountain belong to the upper three plate cylinders 5 and the inking unit 9' with a single ink fountain belongs to the lower plate cylinder 5. The example under consideration is concerned with wet offset printing, and therefore a dampening unit 9*a* is assigned to each of the inking units 9, 9'. All the inking units 9, 9' together with their dampening units 9*a* are installed on a removable inking-unit stand 8 which is movable on rollers 8*a* and the moved away position 8' of which is represented by broken lines. The blanket cylinders 4 and plate cylinders 5 are mounted in an exchangeable machine stand 15 independent of the main stand 1.

Mirror-symmetrically relative to the above-described arrangement belonging to the impression cylinder 2, the impression cylinder 3 interacts with four blanket cylinders 6 which are each in contact with a plate cylinder 7 of the same diameter. Once again, three inking units 11 with a double ink fountain for inking the upper three plate cylinders 7 and an inking unit 11' with a single ink fountain for inking the lower plate cylinder 7 are installed in an inking-unit stand 10 which corresponds to the inking-unit stand 8 and is removable on rollers 10*a* and the moved-away position 10' of which is represented by broken lines. A dampening unit 11*a* is once more assigned to each of the inking units. The blanket cylinders 6 and plate cylinders 7 are mounted in another exchangeable machine stand 16 likewise independent of the main stand 1.

The two machine stands 15 and 16 constitute exchangeable plate-cylinder and blanket-cylinder modules.

The paper web P runs over guide and tensioning rollers 12 in the direction of the arrows, first loops round the impression cylinder 2, one side of the paper being printed directly with individual colors during the passage between the impression cylinder 2 and the inked blanket cylinders 4, and then loops round the impression cylinder 3 in the other direction, the other side of the paper likewise being printed directly with individual colors during the passage between this impression cylinder 3 and the inked blanket cylinders 6. The transfer of the paper web P from the impression cylinder 2 to the impression cylinder 3 takes place directly, without the paper web having to run through a free space, and the distance between the impression cylinders 2 and 3 is calculated only just large enough to ensure that the paper web P can pass through between them. For this purpose, the distance between the two impression cylinders 2 and 3 is adjustable as a function of the paper thickness. Because of this direct transfer of the paper web from the impression cylinder 2 to the impression cylinder 3, the paper tension is kept perfectly constant. At the same time, it is especially beneficial if the paper web loops round the impression cylinders to as great an extent as possible. Thus, in the example under consideration, the paper loops round approximately three quarters of the circumference of the impression cylinder 2 and more than half the circumference of the impression cylinder 3.

In order to execute the in-register transfer of the paper web P from the impression cylinder 2 to the impression cylinder 3 in an especially reliable way, for example the pressing force between the two impression cylinders can at least approximately equal to that pressing force with which an impression cylinder 2, 3 and a blanket cylinder 4, 6 are pressed against one another to form a nip.

The constant paper tension guarantees a perfect see-through register, which is essential in banknotes for reasons of quality and safety against counterfeiting. Both banknote sides can therefore be printed at least partially with the same images and designs and in the same colors and, because of the perfect register obtained in the recto-verso printing, are superposed exactly, so that, in terms of these images and designs, one banknote side is the exact mirror image of the other banknote side, except, of course, for the printed-on texts and numbers.

In the example under consideration, the plate cylinders 5 and 7 inked by the inking units with a double ink fountain carry wet offset-printing plates, whilst the plate cylinders 5 and 7 inked by the inking units 9' and 11' with a single ink fountain are equipped with an intaglio printing plate known per se. In this printing plate, the material limiting the depressions is inkabsorbent and water-repellent, whilst the plate surface outside the depressions is composed of a water-absorbent material which is dampened by the dampening unit 9*a*, 11*a* and thus becomes ink-repellent, so that, during inking, only the depressions are filled with ink. In this case, preferably the image produced by the wet offset plates forms a three-color safety background on each side of the banknote, whilst the said intaglio printing plate produces a single-color main design on each banknote side.

Of course, even all the plate cylinders 5 and 7 can carry wet offset plates which then produce, in particular, a four-color safety background on each banknote side. It is directly possible, furthermore, to equip one, several or all of the plate cylinders 5 and 7 with a dry offset plate, that is to say a typographic printing plate, which is inked by an inking unit suitable for dry offset printing. Banknotes produced partially or completely by dry offset printing, that is to say indirect typographic printing, can be obtained in this way.

Since the impression cylinders 2 and 3 have a seamless closed circumferential surface, it is not important to have a specific ratio of the diameter of the impression cylinders 2 and 3 to the diameter of the blanket cylinders 4 and 6 and of the plate cylinders 5 and 7, and therefore, to change the printing format, the blanket and plate cylinders, the diameter of which essentially determines the format, can be exchanged for smaller or larger blanket and plate cylinders. For this, it is merely necessary to exchange the two machine stands 15 and 16 as a whole for other machine stands, in which blanket and plate cylinders of an appropriately different diameter are mounted. In the example under consideration, this exchange can be carried out after the two inking-unit stands 8 and 10 have been moved away, for example by means of a crane.

The exchangeable machine stands 15 and 16, which in their operating position are fastened and locked to the main stand 1, preferably all have the same construction and the same size, and their bearings intended for receiving the plate and blanket cylinders are adjustable in terms of their position in a way known per se, for example by means of cams. Thus, plate and blanket cylinders of different diameter can be installed in identical machine stands by adjusting the position of the cylinder bearings accordingly.

Figure 2:
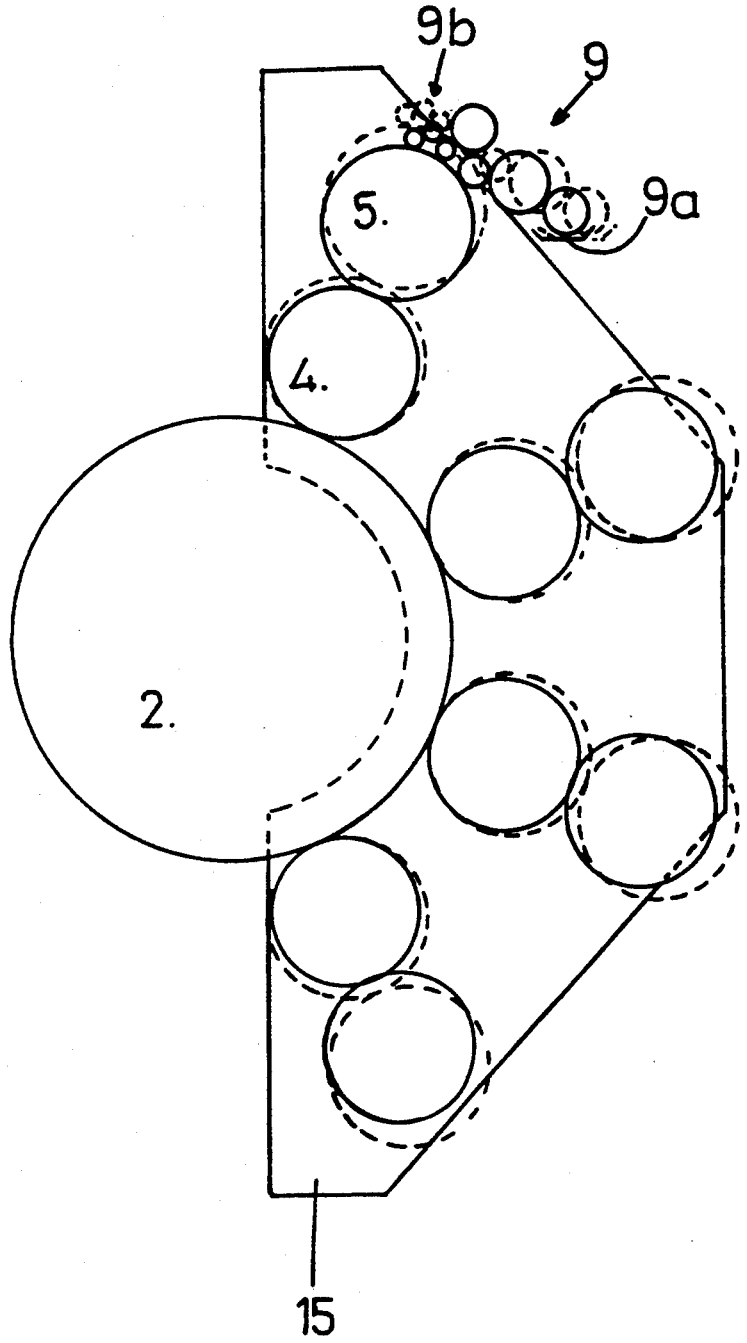
FIG. 2 shows a view of one of the exchangeable machine stands, indicating for the uppermost plate cylinder the inking and applicator rollers of the respective inking unit which are adjacent to it.

The arrangement is such that, when the machine stands 15 and 16 are in the operating positions, the blanket cylinders 4 and 6 assume their correct position in which they can be advanced and set aside in a known way, that is to say pressed against the impression cylinders 2, 3 for printing purposes or moved away from these into an inoperative position. The position of the plate cylinders 5 and 7 is shifted to a greater or lesser extent, depending on the diameter of these and of the blanket cylinders. As indicated in FIG. 2 for the uppermost inking unit 9, in order to adjust the position of the inking units 9, 11 appropriately, the inking rollers 9*b* of the respective inking unit 9 which are adjacent to each plate cylinder 5, especially the respective ink applicator rollers, including the dampening unit 9*a*, are installed adjustably in a way known per se, for example on rocker levers. In FIG. 2, two different positions of these inking rollers 9*b* and of the dampening unit 9*a* for two blanket and plate cylinders of different sizes are represented by unbroken and broken lines. In this way, the inking rollers interacting with the plate cylinders can be adjusted in a simple way in the inking-unit stand, according to the diameter of the plate cylinders.

The correct setting of the inking units can also be assisted by a corresponding adjustment of the operating positions of the inking-unit stands 8 and 10 which are lockable in different positions.

If appropriate, the adjustable arrangement of each pair composed of a plate cylinder 5, 7 and of a blanket cylinder 4, 6 in relation to the respective impression cylinder 2, 3 and the respective inking unit can also be such that, in the exchange of a machine stand 15 or 16 with cylinders of a different diameter, there is no need for any special readjustment of the inking units, since, of course, the exact position of the plate cylinder on the respective impression cylinder is not important.

The range of different diameters of the plate and blanket cylinders can, for example, encompass, in relation to a mean diameter, diameters up to 12% larger and up to 12% smaller. Thus, for example by means of the exchangeable machine stands 15 and 16, it is possible to use plate and blanket cylinders, the diameter of which can be varied in steps from a minimum of 160 mm to a maximum of 200 mm.

Of course, because of the possibility of using plate and blanket cylinders of differing size, the impression cylinder 2, 3 cannot always satisfy the otherwise customary condition that its diameter be an integral multiple of the diameter of the plate and blanket cylinders. Whenever this condition is not satisfied, during each successive rotation of the impression cylinders the fresh ink of the image first printed on the paper by the blanket cylinders 4 comes in contact with a somewhat offset circumferential region of the second impression cylinder 3. It is therefore necessary to prevent the fresh ink from being transferred from the paper side first printed onto the second impression cylinder 3, if the same second impression cylinder with the same surface quality is always to be used for producing different printing formats, that is to say in conjunction with plate and blanket cylinders of correspondingly different diameter.

For this purpose, the surface of the impression cylinder 3 is preferably composed of a smooth metal layer or metal plate in the manner of a wet offset-printing plate which is dampened by a dampening unit 13. This prevents a possible transfer of ink onto the surface of the impression cylinder 3 when the paper web P rests with its previously freshly printed side against the impression cylinder 3.

Instead of this measure, it is also possible to expose the paper web P resting on the impression cylinder 2, after it has been printed and before its transfer onto the impression cylinder 3, to the effect of a suitable drying device 14 which is installed near the circumference of the impression cylinder 2 and behind the blanket cylinders 4 in the direction of rotation of this, as represented by broken lines in FIG. 1. This can be, for example, a drying device working by ultraviolet radiation. A similar drying device can also be provided near the circumference of the other impression cylinder 3. Preferably, these drying devices are combined with known cooling devices, in order to achieve a regulation of the temperature of the two cylinders.

Advantageously, quick-drying inks can also be used, and if appropriate the drying of these is accelerated by means of a drying device.

If the impression cylinder 3 has a surface in a manner of a wet offset-printing plate, the surface of the other impression cylinder 2 is preferably composed of metal, especially steel. Otherwise, if a drying device is used, both impression cylinders 2 and 3 can be composed of steel or have another hard surface. As long as the condition that the diameter of the impression cylinders 2, 3 be an integral multiple of the diameter of the plate and blanket cylinders is satisfied, for example the surface of the impression cylinder 3 can also carry a layer of chromium with a micro-fine grain which easily yields again the ink absorbed by the freshly printed paper side, so that a non-disruptive ink balance between this chromium layer and the printed paper side resting on it is established. The same result can also be obtained with other surface layers which, when in contact with printing inks, lead to an ink balance of this kind, for example with a rubber layer in a manner of offset blankets.

In the example under consideration, the ratio of the diameter of the impression cylinders 2 and 3 to the diameter of the blanket and plate cylinders is 3:1, this generally providing room on each side for four colors to be applied. However, the diameter ratio can also be lower, for example 2:1, or higher, especially 4:1, so that the space available on the circumference of the impression cylinders is then sufficient to apply on each side, for example, three colors in the first-mentioned instance and, for example, five colors in the secondmentioned instance.

One of the plate cylinders on at least one side of the machine can carry a color-collect printing plate, also called an Orlof printing plate, which belongs to a collect-printing unit known per se, such as that described in EP-B-92,887 of the same applicant. In this case, the collect-printing plate which is fastened to the plate cylinder and which can be especially a typographic printing plate is inked by a color-collect cylinder, itself receiving the inks from several color selector cylinders, also called stencil cylinders, which are each inked by their own inking unit. The multi-color image of the color-collect printing plate is then transferred onto the respective side of the paper by the particular blanket cylinder 4 and/or 6. Such a measure further increases the safety against counterfeiting.

If appropriate, the web-fed printing machine according to the invention can also be designed to print by direct typographic printing. In this case, the blanket cylinders being omitted, the typographic-printing plate cylinders, each inked with a color from their particular inking unit, are pressed directly against the impression cylinders 2, 3 and print directly onto the paper. For this purpose, the two impression cylinders 2 and 3 must have a somewhat elastic surface; they then preferably carry rubber layers or rubber blankets.

What is claimed is:

1. A web-fed printing machine for recto-verso offset printing, especially of banknotes, with two first and second impression cylinders (2, 3) which are arranged next to one another in the main stand (1) of the printing machine and between which a paper web (P) runs through, said paper web being of paper having one side and an opposed other side, each of these cylinders being assigned blanket cylinders (4, 6) and several plate cylinders (5, 7) which are themselves inked by inking units (9, 9'; 11, 11') installed on both sides of the printing machine in two removable inking-unit stands (8; 10), wherein the two said impression cylinders have hard seamless continuous circumferential surfaces and around which the paper web (P) partially loops first round the first impression cylinder (2) in one direction and then round the second impression cylinder (3) in the other direction, and wherein installed between the main stand (1) and each of the inking-unit stands (8, 10) arranged on each side of the main stand is an exchangeable machine stand (15, 16) which is independent of the inking unit stands and in which are installed all said plate cylinders (5, 7) assigned to one of the first and the second impression cylinders (2, 3) and said blanket cylinders (4, 6), which each interact with one of these plate cylinders and which serve as ink transfer cylinders and ink one of the sides of the paper, first one side of the paper then the other side of the paper being printed directly with the individual colors, wherein the distance between the two impression cylinders (2, 3) being adjustable as a function of the paper thickness and being only of an amount necessary for the passage of the paper web between the two impression cylinders, so that the transfer of the paper web (P) from the first impression cylinder (2) to the second impression cylinder (3) takes place directly, the pressing force between the two impression cylinders (2, 3) being approximately equal to that pressing force with which an impression cylinder (2, 3) and a blanket cylinder (4, 6) are pressed against one another to form a nip, wherein the exchangeable machine stands (15, 16) each have the same construction and the same size and each having adjustable bearings for adjustable position for the respective plate cylinders (5, 7) and blanket cylinders (4, 6) installed therein, and wherein additional plate cylinders and blanket cylinders of a different diameter are mountable therein as a result of an appropriate adjustment of these adjustable bearings, wherein at least the first impression cylinder (2) which is the first in the direction of run of the paper, being equipped with a drying device (14) with temperature regulation, the drying device (14) at the first impression cylinder (2) being arranged near that portion of the circumference of this first impression cylinder on which the freshly printed paper is located before its transfer to the second impression cylinder (3).

2. A printing machine as claimed in claim 1 including inking rollers (9b) adjacent to the plate cylinders (5, 7) and belonging to the inking units (9, 11), are adjustable in their position for the purpose of adaptation to the selected diameter of the plate cylinders (5, 7).

3. A printing machine as claimed in claim 1, wherein the second impression cylinder (3) which is the second in the direction of run of the paper has a surface layer which is composed of chromium with a micro-fine grain.

4. A printing machine as claimed in claim 1, wherein at least the first impression cylinder (2) which is the first in the direction of run of the paper having a steel surface.

5. A printing machine as claimed in claim 1, wherein, on at least one machine side, one of the plate cylinders (5, 7) carries a color-collect printing plate inked in a multi-color manner by a collect-printing unit.

6. A printing machine as claimed in claim 1, wherein the impression cylinders (2, 3) have gearwheels which intermesh directly without play.

7. A web-fed printing machine for recto-verso offset printing, especially of banknotes with two first and second impression cylinders (2, 3) which are arranged next to one another in the main stand (1) of the printing machine and between which a paper web (P) runs through, said paper web being of paper having one side and an opposed other side, each of these cylinders being assigned blanket cylinders (4, 6) and several plate cylinders (5, 7) which are themselves inked by inking units (9, 9'; 11, 11') installed on both sides of the printing machine in two removable inking-unit stands (8; 10), wherein the two said impression cylinders have hard seamless continuous circumferential surfaces and around which the paper web (P) partially loops first round the first impression cylinder (2) in one direction and then round the second impression cylinder (3) in the other direction, and wherein installed between the main stand (1) and each of the inking-unit stands (8, 10) arranged on each side is an exchangeable machine stand (15, 16) which is independent of the inking unit stands and in which are installed all said plate cylinders (5, 7) assigned to one of the first and the second impression cylinders (2, 3) and said blanket cylinders (4, 6), which each interact with one of these plate cylinders and which serve as ink transfer cylinders and ink one of the sides of the paper, first one side of the paper then the other side of the paper being printed directly with individual colors, wherein the distance between the two impression cylinders (2, 3) being adjustable as a function on the paper thickness and being only of an amount necessary for the passage of the paper web between the two impression cylinders, so that the transfer of the paper web (P) from the first impression cylinder (2) to the second impression cylinder (3) takes place directly, the pressing force between the two impression cylinders (2, 3) being approximately equal to that pressing force with which an impression cylinder (2, 3) and a blanket cylinder (4, 6) are pressed against one another to form a nip, wherein the exchangeable machine stands (15, 16) each have the same construction and the same size and each having adjustable bearings of adjustable position for the plate cylinders (5, 7) and blanket cylinders (4, 6) installed therein, and wherein additional plate cylinders and blanket cylinders of a different diameter are mountable therein as a result of an appropriate adjustment of these adjustable bearings, wherein the second impression cylinder (3) which is the second in the direction of run of the paper is equipped with a metal plate to form a wet offset-printing plate and including a dampening unit (13) for dampening said offset-printing plate.

8. A printing machine as claimed in claim 7 including inking rollers (9*b*) adjacent to the plate cylinders (5, 7) and belonging to the inking units (9, 11), which are adjustable in their position for the purpose of adaptation to the selected diameter of the plate cylinders (5, 7).

* * * * *

UNITED STATES PATENT AND TRADEMARK OFFICE

CERTIFICATE OF CORRECTION

PATENT NO. : 5,136,942

DATED : August 11, 1992

INVENTOR(S) : Albrecht J. Germann

It is certified that error appears in the above-identified patent and that said Letters Patent is hereby corrected as shown below:

On the title page: Item [73]:
Assignee reads: "De La Rue Giorgi S.A. Lausanne, Switzerland"

Should be — De La Rue Giori S.A. Lausanne, Switzerland —

Signed and Sealed this

Twenty-third Day of November, 1993

*Attest:*

Bruce Lehman

BRUCE LEHMAN

*Attesting Officer*

*Commissioner of Patents and Trademarks*